US010018318B2

(12) United States Patent
Luo et al.

(10) Patent No.: US 10,018,318 B2
(45) Date of Patent: Jul. 10, 2018

(54) LIGHTING STRUCTURE OF A VEHICULAR HEADLAMP MODULE

(71) Applicants: EXCELLENCE OPTOELECTRONICS (DONG GUAN) LTD., Dongguan (CN); EXCELLENCE OPTOELECTRONICS INC., Miaoli County (TW)

(72) Inventors: Yuan-Jing Luo, Miaoli County (TW); Ching-Tan Yu, Miaoli County (TW)

(73) Assignees: Excellence Optoelectronics (Dong Guan) Ltd., Dongguan (CN); Excellence Optoelectronics Inc., Hsinchu Science Park (TW)

( * ) Notice: Subject to any disclaimer, the term of this patent is extended or adjusted under 35 U.S.C. 154(b) by 0 days.

(21) Appl. No.: 15/403,496

(22) Filed: Jan. 11, 2017

(65) Prior Publication Data

US 2017/0241609 A1 Aug. 24, 2017

(30) Foreign Application Priority Data

Feb. 22, 2016 (TW) ..... 105105097 A

(51) Int. Cl.
*F21S 41/32* (2018.01)
*F21S 41/25* (2018.01)
(Continued)

(52) U.S. Cl.
CPC ..... *F21S 41/32* (2018.01); *F21S 41/141* (2018.01); *F21S 41/25* (2018.01); *F21S 45/40* (2018.01)

(58) Field of Classification Search
CPC .. F21S 41/43; F21S 41/32; F21S 41/36; F21S 41/33; F21S 41/337
See application file for complete search history.

(56) References Cited

U.S. PATENT DOCUMENTS 4,686,610 A * 8/1987 Cibie ..... F21S 41/285 362/517
6,494,603 B1 * 12/2002 Takada ..... F21S 41/43 362/538

(Continued)

FOREIGN PATENT DOCUMENTS

CN 101235951 B 6/2010
CN 101608763 B 4/2012

(Continued)

*Primary Examiner* — William N Harris
(74) *Attorney, Agent, or Firm* — Rosenberg, Klein & Lee

(57) ABSTRACT

A lighting structure of a vehicular headlamp module includes a reflector, and a base is located under the reflector and has a lighting element. A shade is integrated at the base, and its central region has a shape of arc and protrudes toward the base. A top of a first reflection body has a reflective inclined plane, which is located at the front end of the base and in back of the shade, A second reflection body has a light-blocking inclined plane, which is located at the front end of the base and in front of the shade and located at the other side of the prominent point. A projection lens set is connected with the base. The light emitted from the lighting element is transmitted through, reflected to and refracted by the projection lens set to form a clear light-distributed pattern that prevents from glare.

15 Claims, 8 Drawing Sheets

(51) Int. Cl.
*F21S 41/141* (2018.01)
*F21S 45/40* (2018.01)

(56) References Cited

U.S. PATENT DOCUMENTS 7,008,093 B2 * 3/2006 Fukawa ..... B60Q 1/10 362/539
7,722,232 B2 5/2010 Nakada et al.
8,092,059 B2 1/2012 Yamagata
8,152,346 B2 4/2012 Yatsuda
8,287,165 B2 10/2012 Iwasaki
8,746,941 B2 6/2014 Yamagata et al.
8,820,993 B2 9/2014 Kloos
2007/0247865 A1 * 10/2007 Kinoshita ..... F21S 41/17 362/538
2009/0268480 A1 * 10/2009 Nishihata ..... F21S 41/143 362/516
2010/0002457 A1 * 1/2010 Takada ..... F21S 41/162 362/509
2010/0309679 A1 * 12/2010 Yamagata ..... F21S 41/147 362/539
2011/0261576 A1 * 10/2011 Uchida ..... F21S 41/255 362/512
2011/0280029 A1 * 11/2011 Yamamoto ..... F21S 41/147 362/516
2012/0014125 A1 * 1/2012 Uchida ..... F21S 41/162 362/538
2012/0039083 A1 * 2/2012 Meyrenaud ..... F21S 41/147 362/516
2013/0250600 A1 * 9/2013 Sekiguchi ..... F21S 48/145 362/539
2013/0308328 A1 * 11/2013 Rice ..... F21S 41/147 362/516
2013/0343076 A1 12/2013 Nakada

FOREIGN PATENT DOCUMENTS

EP 2157364 A1 2/2010
EP 2187116 B1 2/2013
TW I363158 B 5/2012
TW M479235 U 6/2014
TW 201527148 A 7/2015

* cited by examiner

LIGHTING STRUCTURE OF A VEHICULAR HEADLAMP MODULE

This application claims priority for Taiwan patent application no. 105105097 filed on Feb. 22, 2016, the content of which is incorporated by reference in its entirely.

BACKGROUND OF THE INVENTION

Field of the Invention

The present invention relates to a lighting structure of a lamp, particularly to a lamp module, which is installed at a front side of a vehicle and uses two different reflection structures to produce a lighting structure of a vehicular headlamp module forming a glareless and clear light-distributed pattern.

Description of the Related Art

In general, a lamp module located at a front end of a vehicle is called a headlamp. In recent years, with the demands for energy conservation for environment protection and the improvement of lighting efficiency, LED headlamps have been gradually developed. Thus, the frequency of using the LED headlamps is gradually increasing. A lighting structure of the LED headlamp uses a lens and a shade (or a blocking plate) to form an image, thereby forming a clear cut-off line that suppresses glare against oncoming vehicles. However, using a shade or the blocking plate for LED headlamp reduced the usage of efficiency of the lighting source.

In a vehicle headlamp of U.S. Pat. No. 8,746,941, a protruding portion is located at the front end of a shade to block light and to lower a cut-off line of a partial region of a light-distributed pattern to suppress glare against oncoming vehicles. The disadvantage of the patent is that the cut-off line is not clear. In U.S. Pat. No. 8,287,165, U.S. Pat. No. 7,722,232 and EP NO. 2187116, a protruding portion are applied to reduce glare against oncoming vehicles, so as to make sure the emitting light distributed pattern comply with regulations. The disadvantages of the patents are that the illuminated brightness is apparently weaker to affect road recognition for a self-driver. In U.S. Pat. No. 8,092,059, an inclined plane is located at a front end of a lighting structure to block the light toward oncoming vehicles, thereby complying with regulations. The disadvantage of the patent is that the light emitted to the oncoming vehicles is blocked, so as to weaken too much the brightness of emitted light in front of a driver. In US patent NO. 20100309679, an inclined plane formed at a front end of a lighting structure is also used for shading light. However, the cost of using two light sources is too high, and there is no additional light structure so that darkness areas are too weak to comply with regulations. In U.S. Pat. No. 8,820,993, a recess is used to improve the light intensity and decrease the contrast of a cut-off line.

Continuing from the abovementioned paragraph, the existing technology for vehicular lamps mainly improves the problem with glare against oncoming vehicles. However, the technology easily reduces the lighting efficiency and illumination intensity of self-vehicular lamps. The insufficient illumination intensity makes an unclear cut-off line and reduces road recognition. To overcome the abovementioned problems, the present invention provides a lighting structure of a vehicular headlamp module, so as to reduce glare of lanes in opposite direction and enhance the light intensity in self-direction, thereby forming a clear cut-off line.

SUMMARY OF THE INVENTION

A primary objective of the present invention is to provide a lighting structure of a vehicular headlamp module, which complies with regulations and reduces glare from oncoming vehicles when light is projected on the ground, lest a driver of the oncoming vehicle produce too harsh light in passing, and which enhances the light intensity of lanes in self-directions, so as to avoid affecting the light intensity of self-vehicle lamps due to reducing the light of lanes in the opposite direction. Thus, a self-driver can still clearly recognize the front road situation to improve the driving safety at night.

Another objective of the present invention is to provide a lighting structure of a vehicular headlamp module, which is installed in illumination lamp at a front side of a vehicle, and which uses reflection and refraction of light to project a light-distributed pattern on the front ground to provide road illumination for a driver.

To achieve the abovementioned objectives, the present invention provides a lighting structure of vehicular headlamp module, which comprises a reflector, a base, a shade, a first reflection body, a second reflection body and a projection lens set. The inner side of the reflector has a reflection surface. The base is located under the reflector, and a rear end of the base is connected with the reflector, and a rear end of the base has a lighting element set at a first focus, and the lighting element projects light on the reflection cover whereby the reflection surface reflects the light to a position of the base that is used as a position of a second focus. The shade is integrated at a front end of the base, and the shade extends from two sides of a front end of the base to center to form an arc and protrudes toward a rear end of the base, and a prominent point of the shade is located at the position of the second focus. The first reflection body is located at a front end of the base and in back of the shade and located at a side of the prominent point close to a vehicle driver. For example, when a driving position of a vehicle is located at the left, the first reflection body is located at the same side as the driving position. A top of the first reflection body has a reflective inclined plane that upwardly tilts from a front end of the base to a rear end of the base. The second reflection body is located at a front end of the base and in front of the shade and located at the other side of the prominent point. When the first reflection body is located at the left, the second reflection body is located at the right, and vice versa. The first reflection body and the second reflection body are respectively located at two sides of the prominent point. A top of the second reflection body has a light-blocking inclined plane that downwardly tilts from front to back. The projection lens set is connected with a front end of the base, and the light emitted from the lighting element to the reflector is transmitted through the shade on the base and the second reflection body, reflected to the projection lens set by the first reflection body and refracted by the projection lens set to form a light-distributed pattern.

After the light emitted from the lighting element to the reflector is reflected to the projection lens set by the first reflection body, the brightness of the light forming the light-distributed pattern is enhanced. After the light emitted from the lighting element to the reflector is reflected by the second reflection body, a part of the light does not pass into the projection lens set to reduce the brightness of the light forming the light-distributed pattern.

The base comprises a light-blocking plate and a heat dissipater. The light-blocking plate is located under the reflector, and a rear end of the light-blocking plate is connected with the reflector, and a rear end of the light-blocking plate has the lighting element, and a front end of the light-blocking plate has the shade, the first reflection body and the second reflection body. The heat dissipater is located under the light-blocking plate to dissipate heat generated by the lighting element. The lighting element is a light-emitting diode (LED). The reflection surface of the reflector is a convergent-reflection surface.

The projection lens set comprises a connection base and a lens. The connection base is connected with a front end of the base. The lens is located at a front end of the connection base to refract the light transmitted through the shade and the second reflection body and reflected by the first reflection body.

Below, the embodiments are described in detail in cooperation with the drawings to make easily understood the technical contents, characteristics and accomplishments of the present invention.

DETAILED DESCRIPTION OF THE INVENTION

With the improvement of nano-technology, the rising of awareness for environment protection and the spread of LED lamps, lighting elements installed on a vehicle are mostly realized with energy-saving LEDs to apply to vehicular headlamps. The nano-technology can apply to a reflector to increase a reflection rate thereof to above 95% while reflecting the light emitted by the LEDs, so as to reduce the lost light energy due to reflection. However, too harsh and too strong light is easily produced in such a case. For a driver, illumination of lanes in self-direction is very clear but easily produces glare against oncoming vehicles. As a result, the present invention provides a lighting structure of a vehicular headlamp module that reduces glare and enhances the light intensity of lanes in self-direction, whereby self-illumination has clear recognition without affecting the driving of others during night driving.

Figure 1:
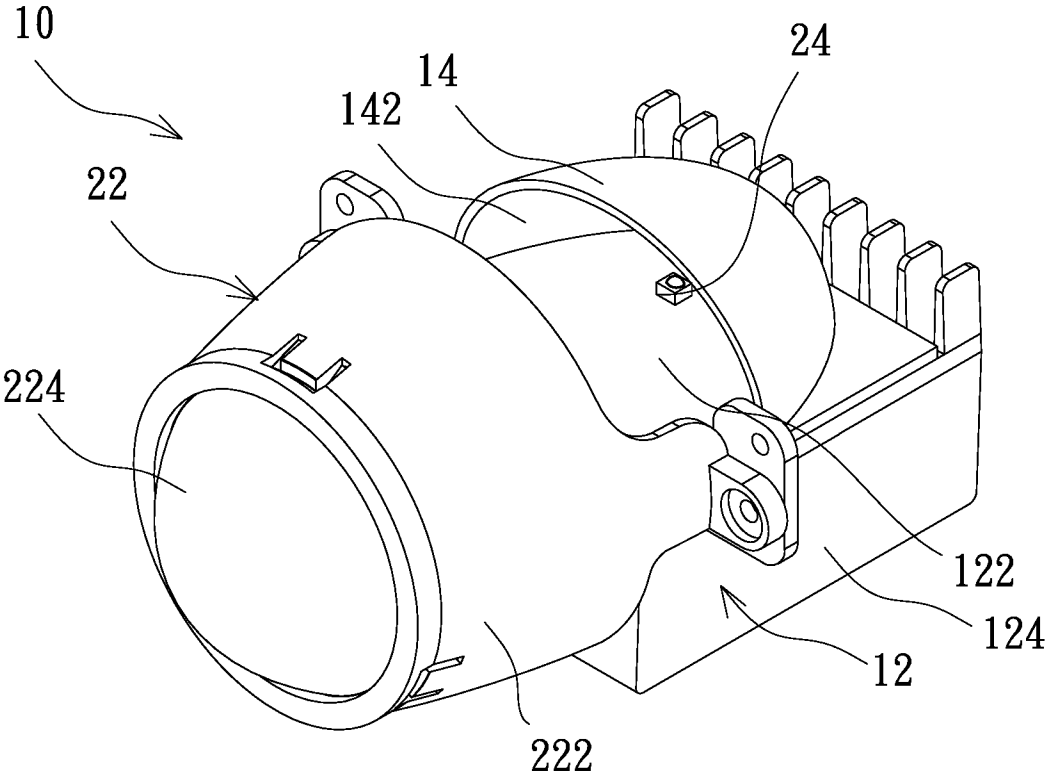
FIG. 1 is a perspective view of a lighting structure according to an embodiment of the present invention.
Figure 2:
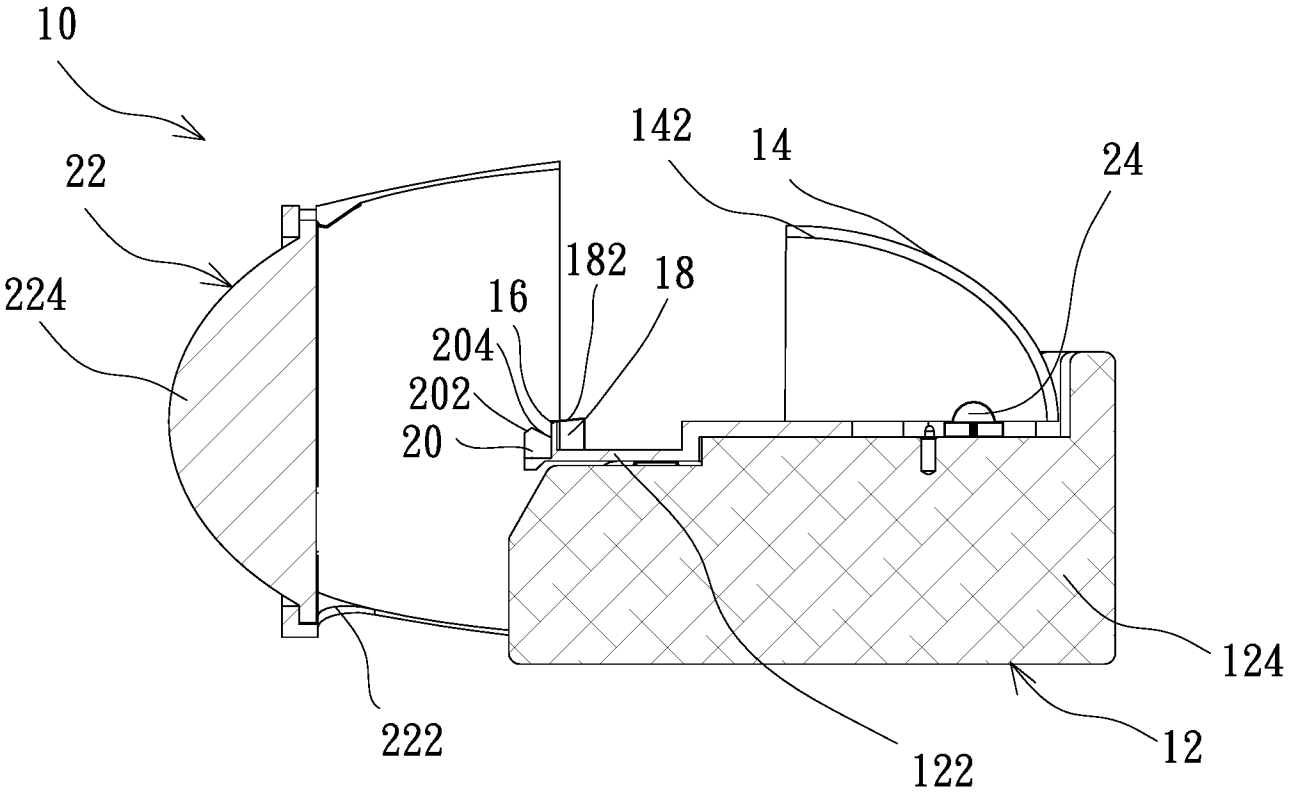
FIG. 2 is a cross-sectional view of a lighting structure according to an embodiment of the present invention.
Figure 3:
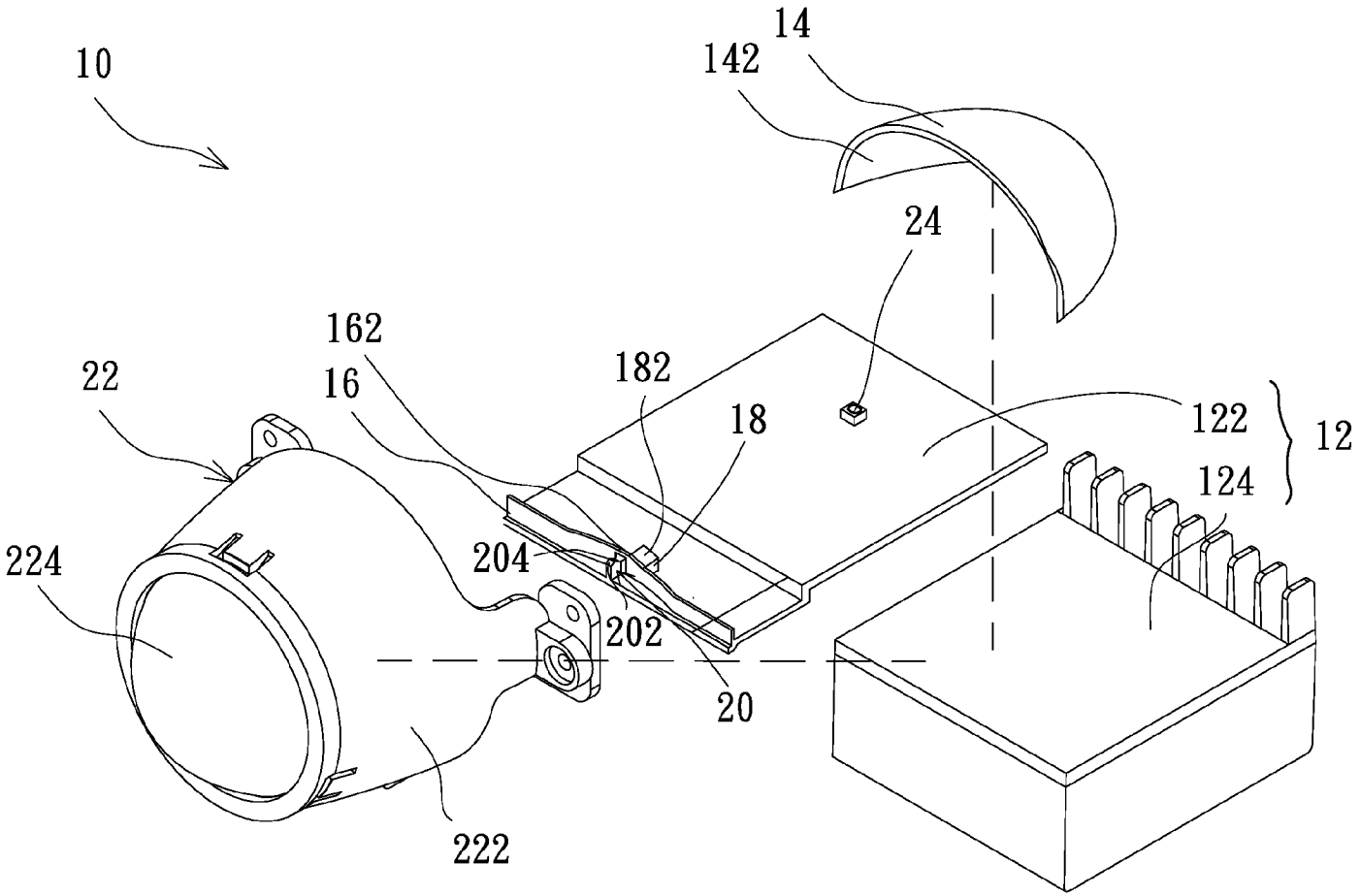
FIG. 3 is an exploded view of a lighting structure according to an embodiment of the present invention.

Refer to FIG. 1, FIG. 2 and FIG. 3. A lighting structure 10 of a vehicular headlamp module comprises a base 12, a reflector 14, a shade 16, a first reflection body 18, a second reflection body 20 and a projection lens set 22, wherein an inner side of the reflector 14 has a reflection surface 142. In the embodiment, the reflection surface 142 is a convergent-reflection surface. The base 12 is located under the reflector 14. The base 12 comprises a light-blocking plate 122 and a heat dissipater 124. The light-blocking plate 122 is located under the reflector 14. The heat dissipater 124 is located under the light-blocking plate 122. A rear end of the light-blocking plate 122 of the base 12 is connected with the reflector 14. A rear end of the light-blocking plate 122 of the base 12 has a lighting element 24. In the embodiment, the lighting element 24 is a light-emitting diode (LED). A shape of the light-blocking plate 122 is adaptable according to requirement of a user. In the embodiment, in order to correspond to a position of the lighting element 24, the light-blocking plate 122 has a shape of, but not limited to, a ladder. The position of the lighting element 24 at the rear end of the base 12 is used as a position of a first focus. Simultaneously, the lighting element 24 emits light to the reflector 14, and the reflection surface 142 reflects the light to the light-blocking plate 122 of the base 12, wherein the position of light-blocking plate 122 is used as a position of a second focus. A distance between the first focus and the second focus is a focal distance. Refer to FIG. 1, FIG. 2, FIG. 3 and FIG. 4. The shade 16 is integrated at a front end of the light-blocking plate 122 of the base 12. The shade 16 extends from two sides of a front end of the base 12 to center to form an arc and the arc protrudes toward a rear end of the base 12. The shade 16 extends toward two sides to form straight lines. A position of a prominent point 162 of the shade 16 is a position of the second focus. The projection lens set 22 comprises a connection base 222 and a lens 224. The connection base 222 is connected with a front end of the base 12. The lens 224 is located at a front end of the connection base 222.

Figure 4:
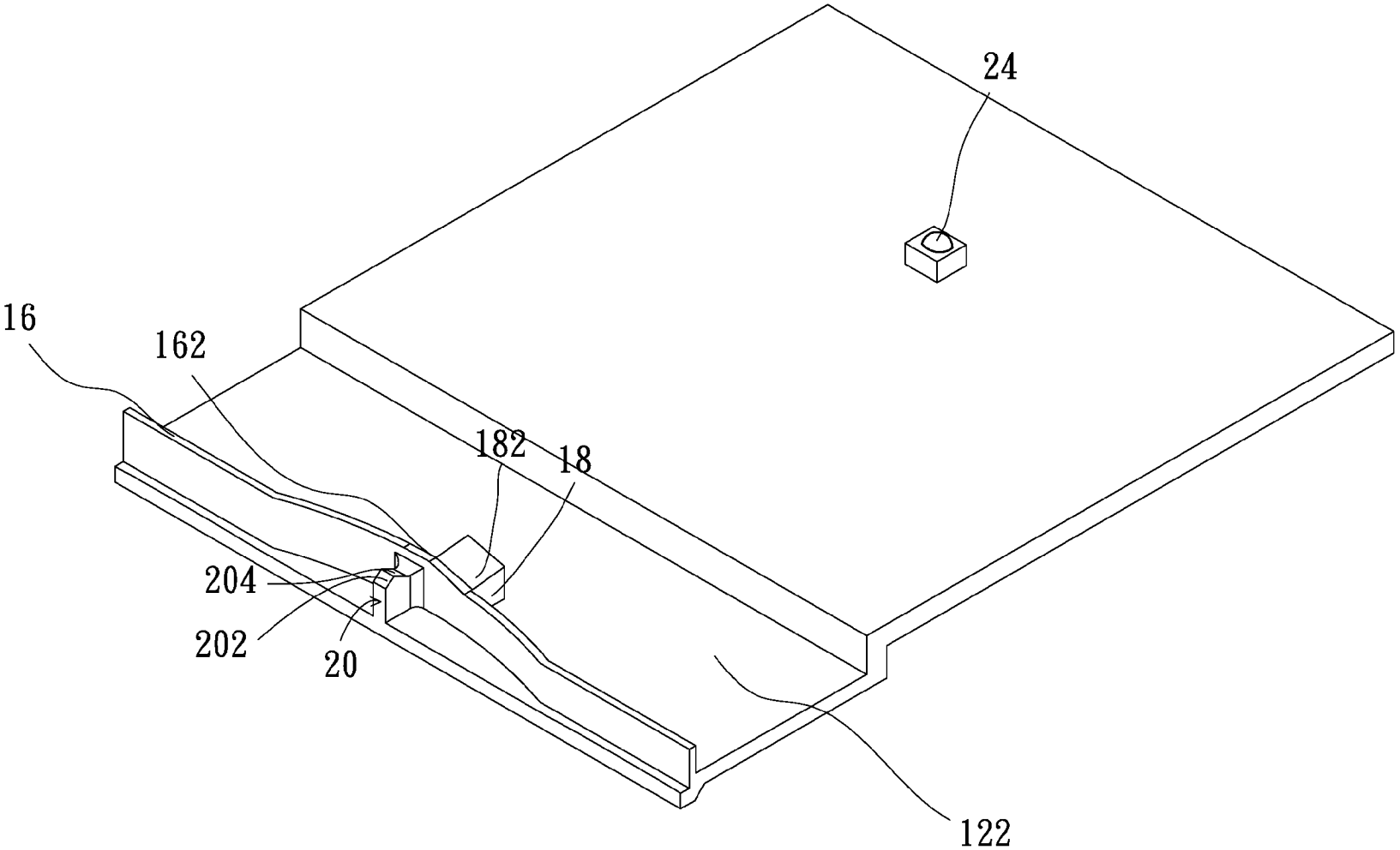
FIG. 4 is a perspective view of a lighting element, a shade, a first reflection body and a second reflection body located on a light-blocking plate according to an embodiment of the present invention.
Figure 5:
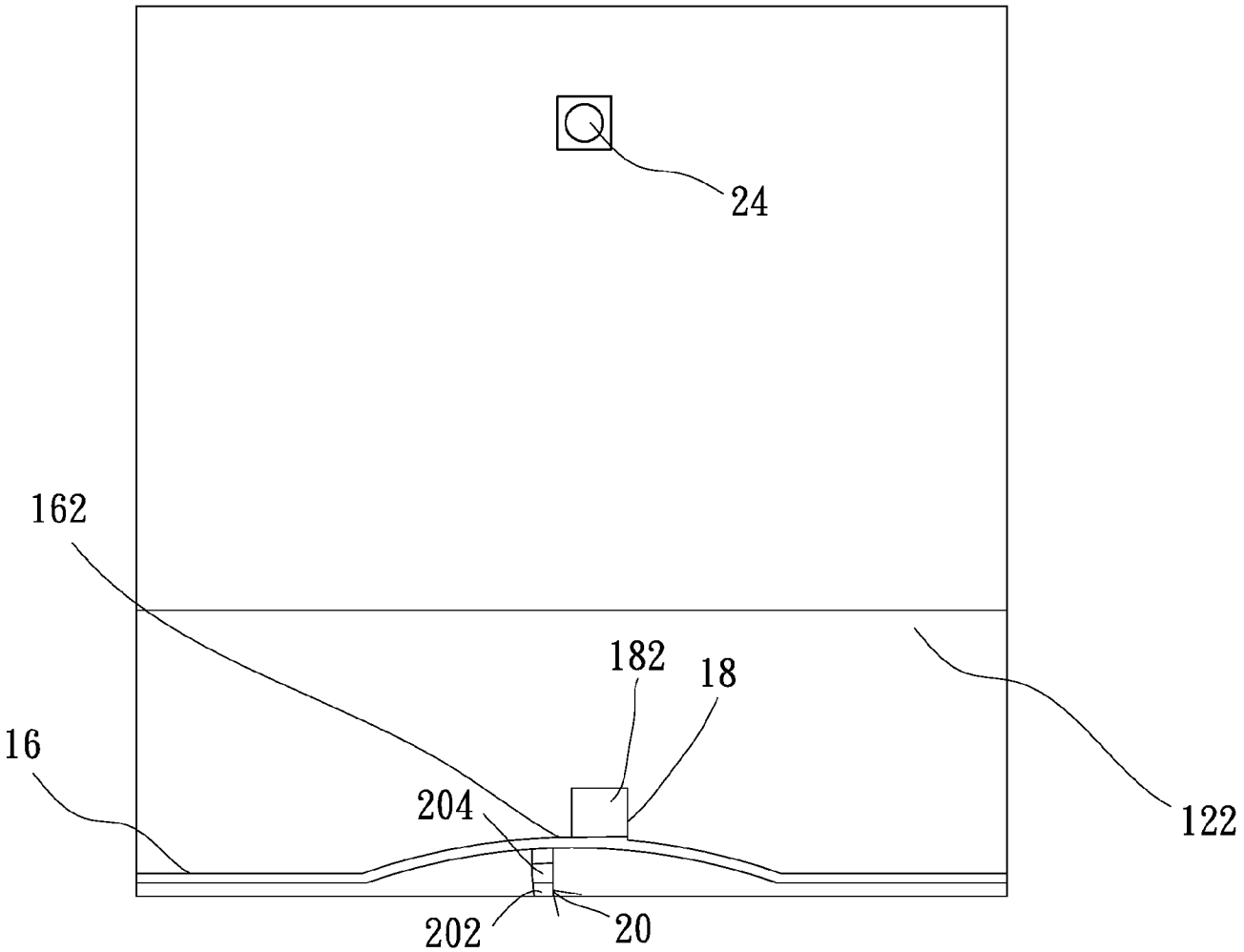
FIG. 5 is a top view of a lighting element, a shade, a first reflection body and a second reflection body located on a light-blocking plate according to an embodiment of the present invention.

Continuing from the abovementioned paragraph, refer to FIG. 5, FIG. 2 and FIG. 4 to describe the clearer position relationship of a first reflection body 18, a second reflection body 20 and the shade 16. The first reflection body 18 is located at a front end of the light-blocking plate 122 of the base 12 and in back of the shade 16. The first reflection body 18 is located at a side of a prominent point 162 of the shade 16 close to a vehicle driver. In Taiwan, a driver sits in the left position in driving. As a result, in the embodiment, the first reflection body 18 is located at the left side of the prominent point 162. The front, rear, left and right directions of the prominent point 162 are based on the directions of the base 12. A top of the first reflection body 18 has a reflective inclined plane 182 that upwardly tilts from a front end of the base 12 to a rear end of the base 12. The second reflection body 20 is located at a front end of the light-blocking plate 122 of the base 12 and located at the other side of the prominent point 162 of the shade 16. Since the first reflection body 18 is located at the left side of the prominent point 162 in the embodiment, the second reflection body 20 is located at the right side of the prominent point 162. A top of the second reflection body 20 has a receiving plane 202 and a light-blocking inclined plane 204. The receiving plane 202 upwardly tilts from front to back and connects with the light-blocking inclined plane 204 at the highest point of the receiving plane 202. The light-blocking inclined plane 204 downwardly tilts from front to back. In the embodiment, the receiving plane 202 is added according to requirement of a user. The receiving plane 202 is convenient for the user to install the second reflection body 20, but the present invention is not limited thereto. The shade 16 has a height that is 4-8 mm from the base 12. The first reflection body 18 has a height that is 5-10 mm from the base 12. The second reflection body 20 has a height that is 2-5 mm from the base 12. The first reflection body 18 is 0-7 mm from the shade 16. The second reflection body 20 is 0-7 mm from the shade 16. The receiving plane 202 is tilted at an angle of 30-70 degrees. The light-blocking inclined plane 204 is tilted at angle of 15-70 degrees. The reflective inclined plane 182 is tilted at angle of 3-8 degrees. In the embodiment, the shade 16 has a height that is 5 mm from the light-blocking plate 122. The first reflection body 18 has a height that is 5-5.51 mm from the light-blocking plate 122. The second reflection body 20 has a height that is 2.2-3.86 mm from the light-blocking plate 122. The first reflection body 18 is 0 mm from the shade 16. The second reflection body 20 is 0 mm from the shade 16. The receiving plane 202 is tilted at an angle of 36.65 degrees. The light-blocking inclined plane 204 is tilted at an angle of 26.57 degrees. The reflective inclined plane 182 is tilted at an angle of 6 degrees. The first reflection body 18 has the reflective inclined plane 182. The highest point of the reflective inclined plane 182 has a height of 5.51 mm, and the lowest point of the reflective inclined plane 182 has a height of 5 mm. Besides, the second reflection 20 has the receiving plane 202 and the light-blocking inclined plane 204. The second reflection 20 is based on the height and angle of the light-blocking inclined plane 204. The receiving plane 202 does not block the light transmitting through the second reflection body 20. The highest position that the receiving plane 202 is connected with the light-blocking inclined plane 204 has a height of 3.86 mm. The lowest position that the receiving plane 202 is connected with the light-blocking inclined plane 204 has a height of 2.2 mm. The embodiment is exemplified by the abovementioned description, but the present invention is not limited thereto.

Figure 6:
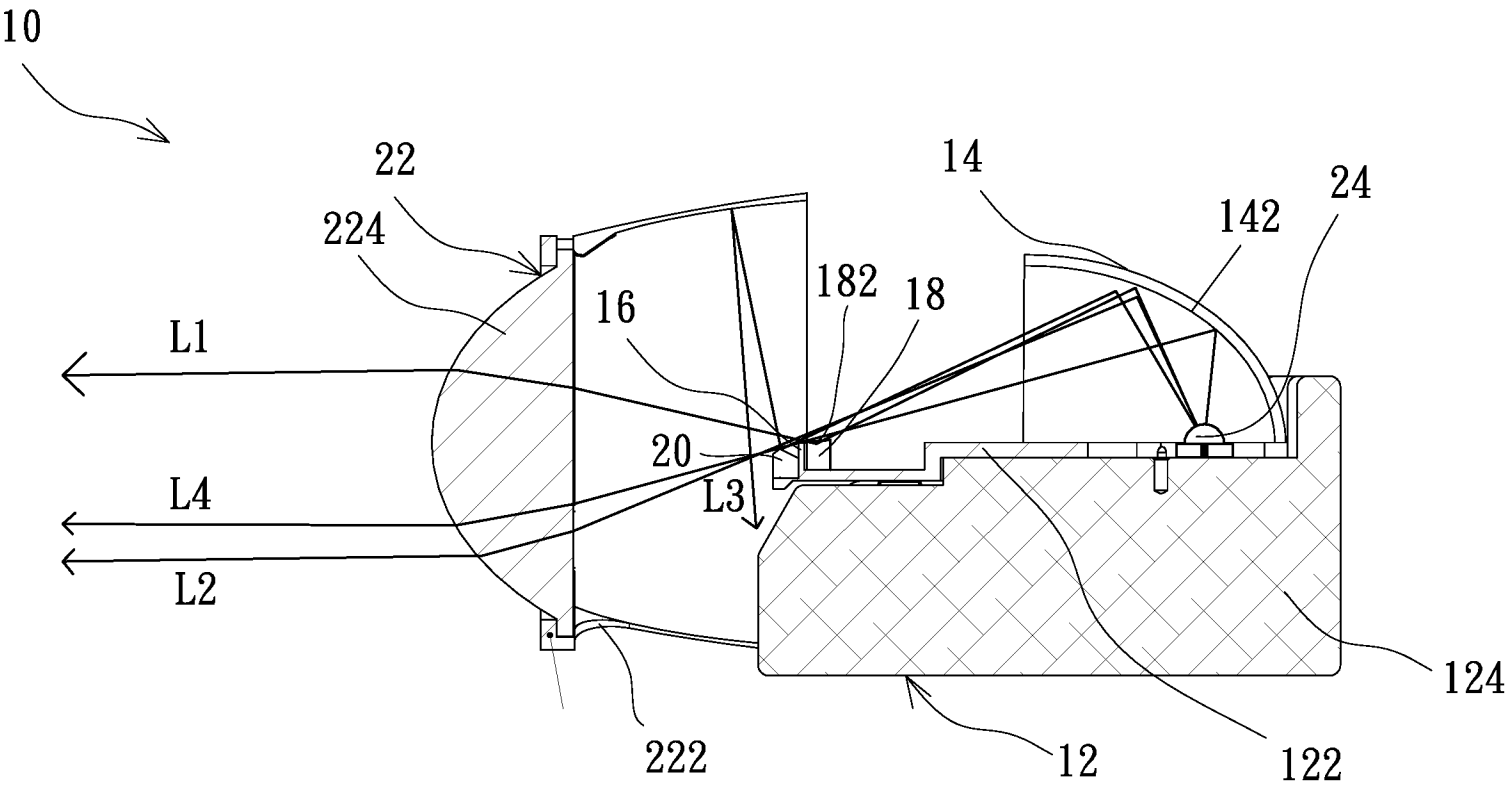
FIG. 6 is a side view of reflection and refraction paths of light according to an embodiment of the present invention.
Figure 7:
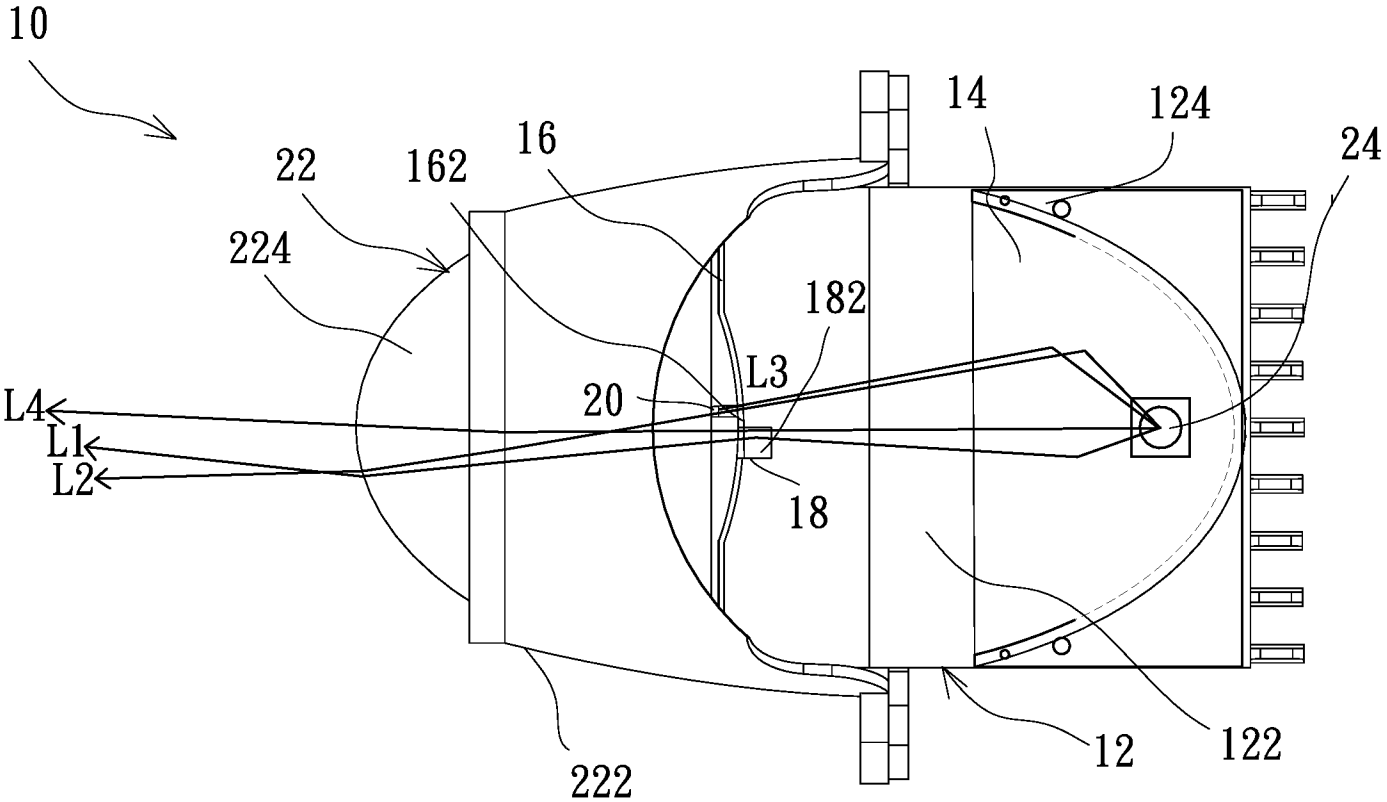
FIG. 7 is a top view of reflection and refraction paths of light according to an embodiment of the present invention.
Figure 8:
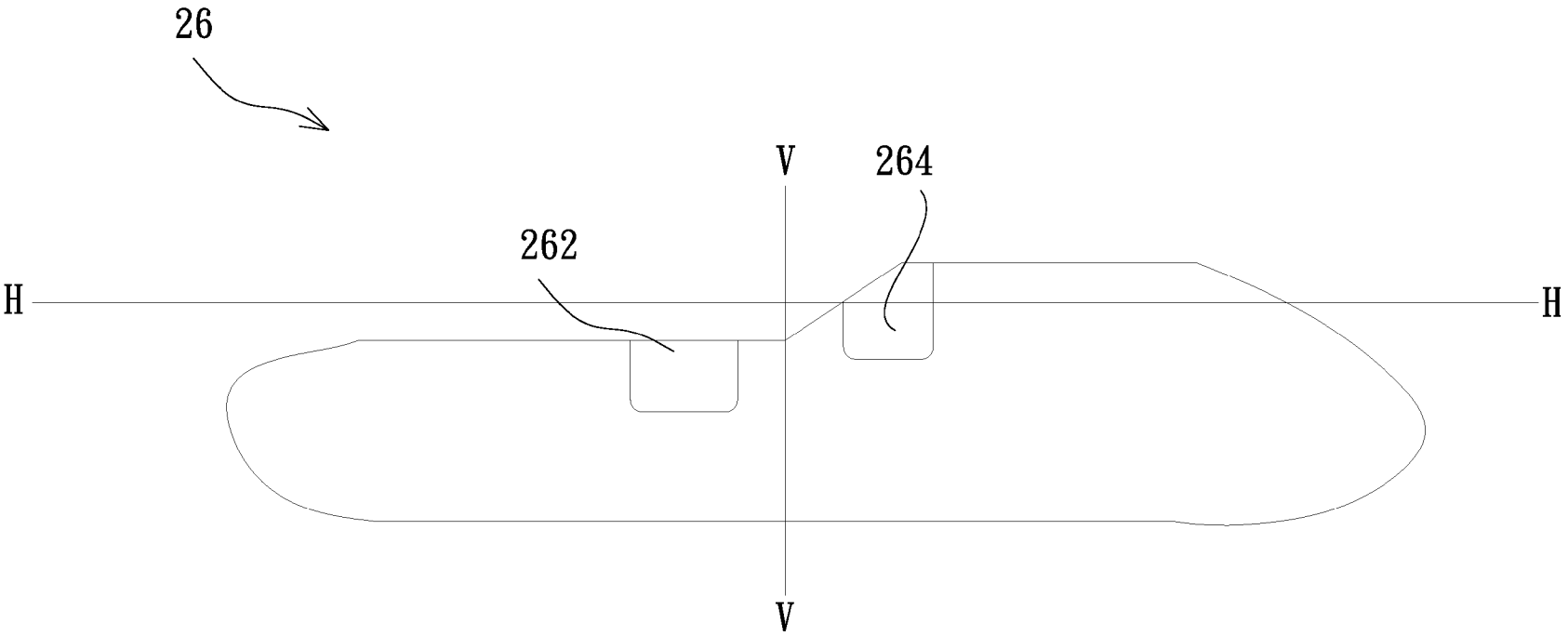
FIG. 8 is a diagram schematically showing a light-distributed pattern formed by refraction of light.

After explaining the structure and connection relationship thereof of the present invention, the practical operation of the present invention is explained. Refer to FIG. 6, FIG. 7 and FIG. 5. The lighting element 24 emits light to the reflector 14, such that the reflector 14 reflects the light to the second focus of the base 12. Simultaneously, the reflective inclined plane 182 of the first reflection body 18 reflects the light to the projection lens set 22. The lens 224 refracts the light to project light along a first projection path L1. When the light passes through the second reflection body 20, the light-blocking inclined plane 204 reflects a part of the light to the connection base 222 of the projection lens set 22. The light reflected to the connection base 222 passes along a third projection path L3. The other light not reflected by the light-blocking inclined plane 204 is transmitted to the projection lens set 22 through the highest point that the receiving plane 202 is connected with the light-blocking inclined plane 204. Then, the lens 224 refracts the light to project light along a second projection path L2. When the light passes through the shade 16, a part of the light is blocked due to the height of the shade 16, and the other light is transmitted to the projection lens set 22. Then, the lens 224 refracts the light to project light along a fourth projection path L4. When the lighting element 24 emits the light, a part of the light reflected to the light-blocking plate 122 will produce heat that can be dissipated by the heat dissipater 124 under the light-blocking plate 122.

Then, refer to FIG. 8, FIG. 2, FIG. 6 and FIG. 7 of the present invention. The light along the first projection path L1, the second projection path L2, the third projection path L3 and the fourth projection path L4 refracted from the lens 224 can be projected on the ground in front of a vehicle, so as to form a light-distributed pattern 26 that is divided into two lanes by a vertical line V. The lane in an opposite direction is located at the left side of the vertical line V, and the lane in a self-direction of a driver is located at the right side of the vertical line V. A horizontal line H denotes the horizontal of a road in front of the driver. An area above the horizontal line H represents a darkness area that a vehicular light is difficulty projected. An area below the horizontal line H represents a lightness area that the vehicular light is mainly projected. Cut-off lines of the top of the light-distributed pattern 26 and the brightness of the light projected on the middle of the light-distributed pattern 26 comply with regulations. The light-distributed pattern 26 at the left side of the vertical line V is located in the lane in the opposite direction, and the light-distributed pattern 26 at the right side of the vertical line V is located in the lane in the self-direction. As a result, the cut-off line of the light-distributed pattern 26 at the left side of the vertical line V is lower than the horizontal line H to avoid projecting too much light on the lane in the opposite direction. The cut-off line of the light-distributed pattern 26 at the right side of the vertical line V is higher than the horizontal line H to provide the driver with light projection of longer distance in the self-direction. However, since the second reflection body 20 of the present invention is provided with the light-blocking inclined plane 204, the light-blocking inclined plane 204 does not reflect a part of the light the lens 224 but reflects the light along the third projection path L3 to the connection base 222 of the projection lens set 22, so as to reduce the brightness of a first lightness area 262 of the light-distributed pattern 26. The first lightness area 262 is roughly located in a position of a driver on the lane in the opposite direction, namely the lightness area projected on the lane in the opposite direction. Thus, the light intensity of the first lightness area 262 at the left is decreased to reduce glare against the driver on the lane in the opposite direction. The first reflection body 18 enhances the brightness of the light forming the light-distributed pattern 26, whereby the brightness of the second lightness area 264 of the light-distributed pattern 26 is enhanced. The second lightness area 264 is located in front of the driver, namely the lightness area projected on the lane in the self-direction. Enhancing the brightness of the second lightness area 264 can increase the light intensity of the lane in the self-direction, so that the region in front of the driver is more clearly illuminated. Thus, the driver can possess better road recognition at night. The light reflected by the shade 16 is refracted by the lens 224 to form the other lightness area of the light-distributed pattern 26.

The heights of the abovementioned first reflection body, second reflection body and shade are used to explain the embodiment and have units of millimeter. In addition, due to the different size of vehicle lamps, the focal distance between the first focus and the second focus is also used as a measurement standard. For example, the shade has a height that is 1/38-1/8 of the focal distance from the base, the first reflection body is 0-1/10 of the focal distance from the shade, and a height of the first reflection body is within 1/10 of the focal distance above a height of the shade or equal to a height of the shade, and the first reflection body is 0-1/10 of the focal distance from the second focus, and the second reflection body is 0-1/10 of the focal distance from the shade, and a height of the second reflection body is within 1/10 of the focal distance above a height of the shade or equal to a height of the shade, and the second reflection body is 0-1/10 of the focal distance from the second focus. The size of the first reflection body, the second reflection body and the shade is also based on the abovementioned limitation. The present invention should not limit the values of the size. The preferred embodiment is exemplified with the abovementioned values to form the cut-off line complying with regulations. The positions of the first reflection body and the second reflection body are adaptable according to the local driving position. The first reflection body and the second reflection body described in the specification and drawings of the present invention are adaptable according to Taiwan regulations. In Taiwan, the driving position is arranged at the left. When the driving position is arranged at the right, the abovementioned structures are contrarily designed and the projected light-distributed pattern is also contrary. The spirit of the present invention is to use the first reflection body and the second reflection body to form the lighting structure that can reduce the brightness of the lane in opposite direction and enhance the brightness of the lane in self-direction. In addition, the present invention can reduce glare against the driver on the lane in the opposite direction, improve illumination of the front lane in the self-direction in driving, and use the light-distributed pattern complying with regulations to produce the clear cut-off line to greatly improve the driving safety.

The embodiments described above are only to exemplify the present invention but not to limit the scope of the present invention. Therefore, any equivalent modification or variation according to the shapes, structures, features, or spirit disclosed by the present invention is to be also included within the scope of the present invention.

What is claimed is:

1. A lighting structure of a vehicular headlamp module comprising:

a reflector with an inner side thereof having a reflection surface;

a base located under said reflector, and a rear end of said base is connected with said reflector, and said rear end of said base has a lighting element whose position is a position of a first focus, and said lighting element emits light on said reflector whereby said reflection surface reflects light to a position of said base that is used as a position of a second focus;

a shade integrated at a front end of said base, and said shade extends from two sides of said front end of said base to center to form an arc and protrudes toward said rear end of said base, and a prominent point of said shade is located at said position of said second focus;

a first reflection body located at said front end of said base and in back of said shade and located at a side of said prominent point close to a vehicle driver, and a top of said first reflection body has a reflective inclined plane that upwardly tilts from said front end of said base to said rear end of said base;

a second reflection body located at said front end of said base and in front of said shade and located at an other side of said prominent point, and a top of said second reflection body has a light-blocking inclined plane that downwardly tilts from front to back; and a projection lens set connected with said front end of said base, and said light emitted from said lighting element to said reflector is transmitted through said shade on said base and said second reflection body, reflected to said projection lens set by said first reflection body and refracted by said projection lens set to form a light-distributed pattern.

2. The lighting structure of a vehicular headlamp module according to claim 1, wherein a distance between said first focus and said second focus is a focal distance.

3. The lighting structure of a vehicular headlamp module according to claim 2, wherein said first reflection body is 0-1/10 of said focal distance from said shade, and a height of said first reflection body is within 1/10 of said focal distance above a height of said shade or equal to a height of said shade, and said first reflection body is 0-1/10 of said focal distance from said second focus.

4. The lighting structure of a vehicular headlamp module according to claim 3, wherein said second reflection body is 0-1/10 of said focal distance from said shade, and a height of said second reflection body is within 1/10 of said focal distance above a height of said shade or equal to a height of said shade, and said second reflection body is 0-1/10 of said focal distance from said second focus.

5. The lighting structure of a vehicular headlamp module according to claim 4, wherein said shade has a height that is 1/38-1/8 of said focal distance from said base.

6. The lighting structure of a vehicular headlamp module according to claim 1, wherein said first reflection body is 0-7 mm from said shade, and said second reflection body is 0-7 mm from said shade.

7. The lighting structure of a vehicular headlamp module according to claim 6, wherein said shade has a height that is 4-8 mm from said base.

8. The lighting structure of a vehicular headlamp module according to claim 7, wherein said first reflection body has a height that is 5-10 mm from said shade, and said second reflection body has a height that is 2-5 mm from said shade.

9. The lighting structure of a vehicular headlamp module according to claim 1, wherein said light-blocking inclined plane is tilted at angle of 15-70 degrees.

10. The lighting structure of a vehicular headlamp module according to claim 1, wherein said reflective inclined plane is tilted at angle of 3-8 degrees.

11. The lighting structure of a vehicular headlamp module according to claim 1, wherein said first reflection body enhances brightness of said light forming said light-distributed pattern, and said second reflection body reduces brightness of said light forming said light-distributed pattern.

12. The lighting structure of a vehicular headlamp module according to claim 1, wherein said base further comprises:

a light-blocking plate located under said reflector, and a rear end of said light-blocking plate is connected with said reflector, and said rear end of said light-blocking plate has said lighting element, and a front end of said light-blocking plate has said shade, said first reflection body, and said second reflection body; and a heat dissipater located under said light-blocking plate to dissipate heat generated by said lighting element.

13. The lighting structure of a vehicular headlamp module according to claim 1, wherein said projection lens set further comprises:

a connection base connected with said front end of said base; and a lens located at a front end of said connection base to refract said light transmitted through said shade and said second reflection body and reflected by said first reflection body.

14. The lighting structure of a vehicular headlamp module according to claim 1, wherein said lighting element is a light-emitting diode (LED).

15. The lighting structure of a vehicular headlamp module according to claim 1, wherein said reflection surface of said reflector is a convergent-reflection surface.

* * * * *